United States Patent [19]

Arana-Erana

[11] Patent Number: 4,899,803

[45] Date of Patent: Feb. 13, 1990

[54] DOUBLE CARRIAGE FOR AUTOMATIC TOOL CHANGE IN CORE MAKING MACHINES FOR CASTING

[76] Inventor: Augustin Arana-Erana, Zorrestes 4 Poligono Industrial Ali-Gobeo, Vitoria (Alava), Spain

[21] Appl. No.: 254,409

[22] Filed: Oct. 6, 1988

[30] Foreign Application Priority Data

Oct. 8, 1987 [ES] Spain ..... 8702879

[51] Int. Cl.[4] ..... B22C 19/00; B22C 23/00

[52] U.S. Cl. ..... 164/158; 164/341; 164/342; 164/412

[58] Field of Search ..... 164/228, 158, 412, 341, 164/342

[56] References Cited

U.S. PATENT DOCUMENTS

| | | | |
|---|---|---|---|
| 3,277,538 | 10/1966 | Bryce | 164/158 |
| 4,142,573 | 3/1979 | Michelson | 164/412 X |
| 4,572,273 | 2/1986 | Katashima | 164/412 X |
| 4,741,380 | 5/1988 | Landua et al. | 164/228 X |

FOREIGN PATENT DOCUMENTS

| | | | |
|---|---|---|---|
| 1284049 | 11/1968 | Fed. Rep. of Germany | 164/412 |
| 2654442 | 12/1977 | Fed. Rep. of Germany | 164/412 |
| 511998 | 6/1976 | U.S.S.R. | 164/412 |
| 1228962 | 5/1986 | U.S.S.R. | 164/158 |

*Primary Examiner*—Nicholas P. Godici
*Assistant Examiner*—J. Reed Batten, Jr.
*Attorney, Agent, or Firm*—Helfgott & Karas

[57] ABSTRACT

The carriage comprises two sets of motor-driven rollers receiving and expelling the tools or boxes of cores. The carriage further includes a rolling frame having wheels driven by a reduction motor. A further reduction motor is provided in each of two operative sectors of the carriage, which activates a corresponding group of rollers through an intermediary transmission shaft. The carriage also has handling devices for the tools in order to permit and facilitate their periodic cleaning. The handling devices each include a support on which a tiltable arm is assembled, which is activated by a hydraulic cylinder. A plate is positioned on the arm on guides. The plate has clamps to secure the tool or box of cores. The plate is moved by a hydraulic cylinder. The structure may be used for boxes of cores with vertical opening and with the boxes having a horizontal opening as well.

3 Claims, 3 Drawing Sheets

1
2
3
4
5
6
7
7'
8
8'
9
10
11
12
13

FIG.-5
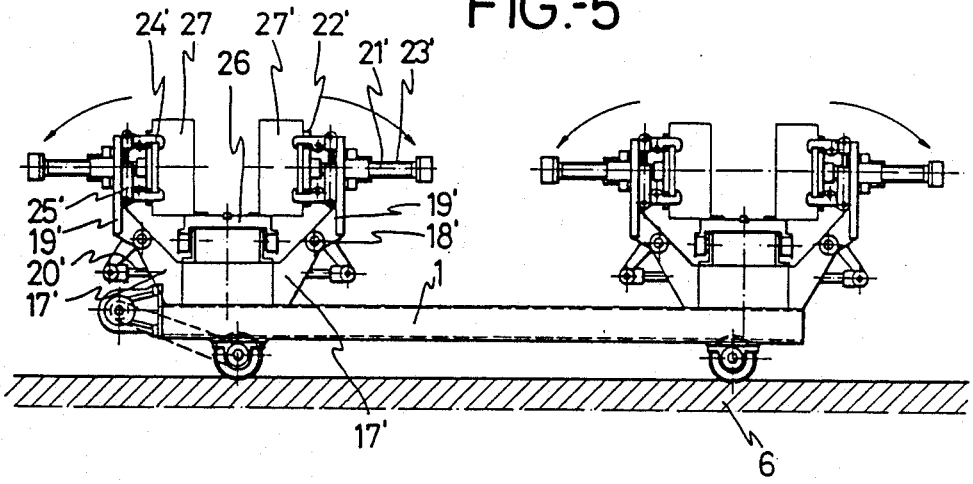
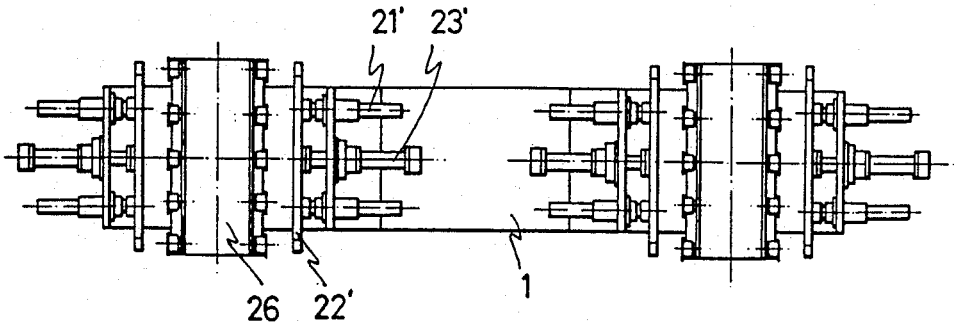
FIG.-6

DOUBLE CARRIAGE FOR AUTOMATIC TOOL CHANGE IN CORE MAKING MACHINES FOR CASTING

FIELD OF THE INVENTION

This invention relates to a double carriage for automatic tool change, in core making machines for casting, whose purpose is to collect from the machine any jigs or tools that have already been used, and replace them with new ones, in an fully automatic performance.

BACKGROUND OF THE INVENTION

In any core making machine for casting it is clearly essential to replace the tool at the end of each work process corresponding to obtaining a certain core for casting. The tools or boxes of cores are in themselves heavy tonnage parts, which create problems of handling during transportation, and different solutions are used, ranging from bridge cranes to different kinds of motorized carriages, for the obvious purpose of transferring the tools from the corresponding warehouse to the machine and vice versa. Any of these solutions, irrespective of their more or less structural complexity, presents the fundamental problem that it is impossible to establish an automatic control system for changing tools, and the work process calls for an important manual participation.

In order to overcome this problem, the applicant has proposed in his Spanish patent No. 8602461 a mechanism for changing tools in core blower machines, which permits the tool change to be carried out in a fully automatic way.

However, in the solution which was offered in that patent, although the required objectives were reached, two important problems nevertheless remained: on the one hand, the carriage that was used as means for transporting the jibs is structurally complex and consequently expensive, and, on the other hand, no means are envisaged in that mechanism that permit the boxes of cores to be cleaned periodically, and this is necessary because agglomerant sand accumulates in them, which means tha unless these are cleaned periodically and relatively frequently, the boxes of cores lose measurements, the air inlet filters may become blocked and the elements that eject the manufactured cores may become clogged.

Thus, in a core production process for casting, at predetermined periods of time, the boxes must be taken out of the machine, cleaned and suitably fitted in the machine again. In the mechanism for automatic tool change mentioned above, no specific measures have been envisaged for these jobs.

SUMMARY OF THE INVENTION

It is an object of the present invention to provide an improved carriage for automatic change of tools which satisfactorily overcomes the above problem and which carriage, in itself, is a far more simple solution from a structural point of view, with the consequent reduction in costs, from the point of view of the carriage manufacture and its subsequent maintenance. In addition, this carriage incorporates means that allow for a periodic cleaning of boxes of cores, thus resolving the second side of the above-described problem.

More specifically the carriage of the present invention is comprised of a rolling frame, in which one of its shafts is a drive shaft, operated by a reduction motor.

The carriage slides along rails laid out for this purpose on the floor between the core making machine and the corresponding tool warehouse. There is provided another set of reduction motors on the frame which are designed to activate the rollers which mobilize the tools in their movement to the machine and their subsequent extraction, and also during their movement to the warehouse and extraction from the same. There are two reduction motors to activate the rollers because there are two work zones on the frame, since this is a double carriage, one for transporting the tool which is to be implanted in the machine, and the other to receive the tool which is in an operative state in the machine and which must be withdrawn before the new tool is implanted.

On this basic structure of the carriage, which is self-sufficient for feeding and extracting tools as regards the machine for making cores for casting, there is an ancillary mechanism for periodic cleaning of the boxes of cores. This ancillary mechanism with the same basic confection, offers two specific performance depending on the kind of boxes of cores that are to be handled, because there are boxes of cores that have a vertical opening device and boxes of cores that have a horizontal opening device.

Specifically in the first case, namely boxes of cores that have a vertical opening, there is a box frame in these boxes, inside which are positioned core ejectors, and on this frame there is a lower middle box, and, completing the unit, an upper half box of cores is positioned on the middle box. In this type of box, the ideal situation for cleaning is an upright arrangement of the upper half box of cores, which furthermore should be shifted laterally in respect to the lower half box of cores. The ancillary mechanism is accordingly implemented on a support secured to the carriage frame, in correspondence with each end, namely with each of its operative sectors. A lever is joined articulately to the support, which is operated with the aid of a hydraulic cylinder. At the free end of the lever, with the aid of guides and the assistance of another hydraulic cylinder, it receives a shifting plate, which contains clamps for the upper half box, so that the plate can adopt a horizontal position, can approach the entire box of cores through the drive of the corresponding hydraulic cylinder, maintaining this horizontal position; it can secure the upper half box through the clamps that are associated with it, and then move up and finally tilt, as the arm does so in respect to the lower side support, through the other hydraulic cylinder. The upper half box consequently assumes an upright position and is displaced outwards in respect to the rest of the box of cores, which is the best position for cleaning.

When the box of cores has a horizontal opening, in which case there is also a lower box frame with two side adjacent boxes which are designed to be separated from one another by moving horizontally in respect to each other, the mechanism is very similar to the described above with the only exception that the structure described is double, that is to say, there are two plates, one for each half of the box of cores, which are now arranged parallelly and vertically in fixture phase, and which, after being secured and with the clamps described in the above case, are moved and spaced, activated by corresponding hydraulic cylinders and at the end of this spacing phase they tilt, specifically when the levers, to which the plates are joined on the corresponding lower supports, do so, and by action of respective hydraulic cylinders which connect each support to its corresponding lever, a complete independence is obtained between the two halves of the box of cores and the box-holder frame, which ensures an optimum positioning for the different elements of the box of cores, for their cleaning.

The aforementioned objects, features and advantages of the invention will, in part, be pointed out with particularity, and will, in part, become obvious from the following more detailed description of the invention, taken in conjunction with the accompanying drawing, which form an integral part thereof.

BRIEF DESCRIPTION OF THE DRAWINGS

FIG. 5 is in a similar representation as that of FIG. 3 of a carriage that holds an ancillary cleaning mechanism suitable for boxes of cores, whose opening is performed horizontally; and FIG. 6 is a top view of the assembly represented in FIG. 5.

DETAILED DESCRIPTION OF THE PREFERRED EMBODIMENTS

Figures 1, 2:
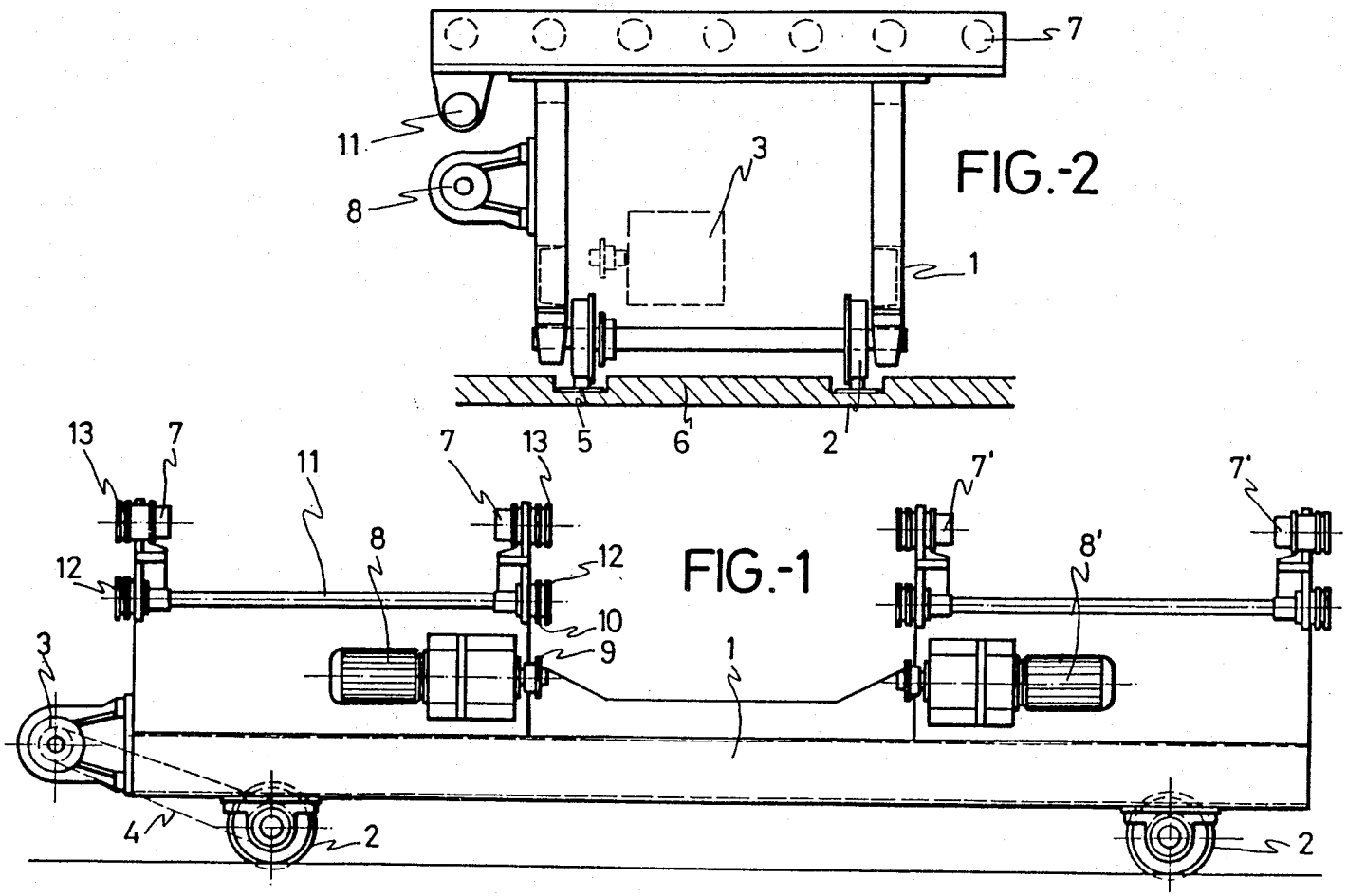
FIG. 1 is a diagrammatic side section of a double carriage for automatic tool change in core making machines for casting, in accordance with the invention, where the cleaning means for the boxes of cores have not yet been implanted.
FIG. 2 is a side view of the same assembly as shown in FIG. 1.

Referring more specifically to FIGS. 1 and 2, it can be observed that the carriage is formed of a frame 1, which contains wheels 2, where those corresponding to one of its shafts are drive wheels and receive the movement from a reduction motor 3 secured to the frame 1, through a transmission 4. Wheels 2 are designed to move the carriage on rails 5 which are duly implanted on a floor 6 and which connect the core-making machine or machines for casting with the corresponding tool warehouse.

Inside frame 1 there are two groups of rollers 7–7', at the ends, which are designed to receive each of the tools are driven by respective reduction motors 8–8', whose outlet sprocket 9 transmits the movement to a sprocket 10 which is joined to a shaft 11 from which, at its ends and through sprockets 12, is the movement transmitted to sprockets 13 associated with the shaft of rollers 7 or 7'.

Figure 3:
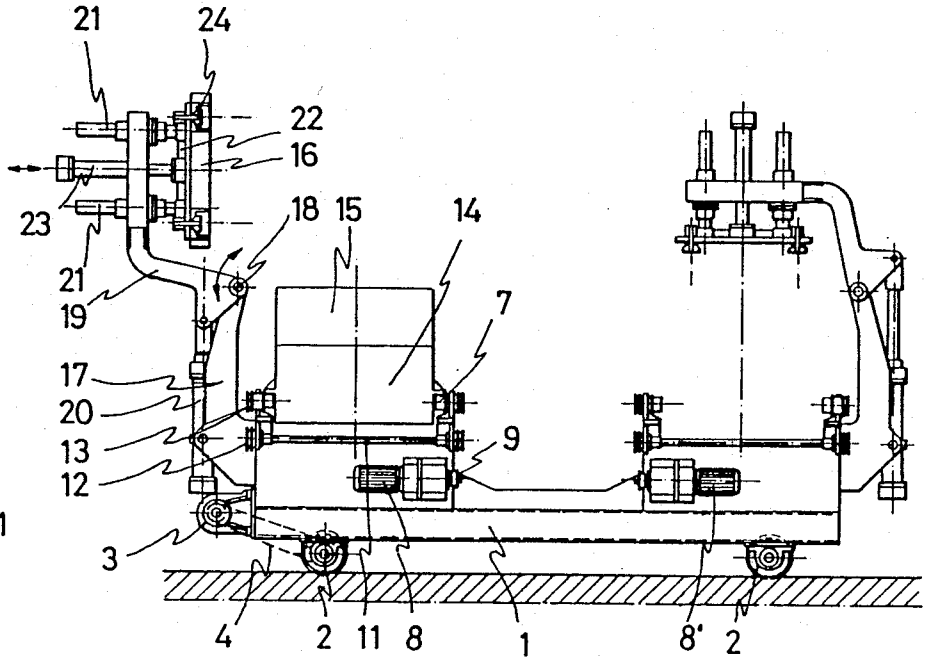
FIG. 3 is a similar representation as FIG. 1, but showing the carriage which an ancillary mechanism which permits cleaning of boxes of cores, specifically the execution corresponding to the case where the opening of the boxes of cores is performed in an upright direction.

Thus an extremely simple structure is obtained for the carriage which is capable of receiving two tools at the same time, at each of its end sectors, specifically at its sets of rollers 7 and 7', as can be observed in figures 3, 5 and 6.

Using this basic structure of the carriage, which is maintained for any type of box of cores, the carriage is completed with an ancillary mechanism, for which two specific embodiments have been foreseen, depending on the type of boxes of cores to be handled; the embodiments are shown, respectively, in FIGS. 3 and 4 and FIGS. 5 and 6.

Figure 4:
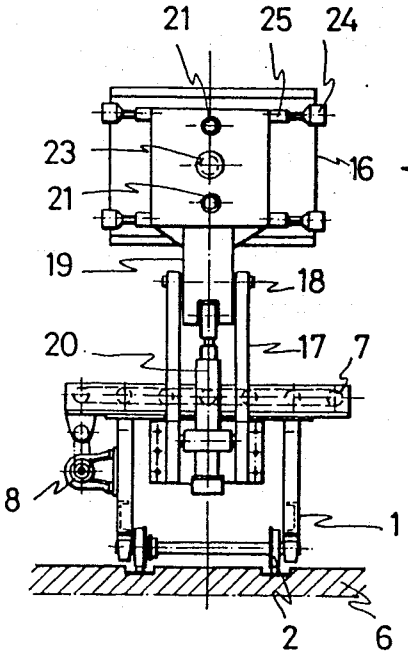
FIG. 4 is a side view of the assembly of FIG. 3.

Specifically, in FIGS. 3 and 4, as has already been mentioned, a complete carriage has been shown for use with boxes of cores the opening of which is made vertically and where there is a lower box frame 14, a lower half box of cores 15 and an upper half box of cores 16.

In this specific case, frame 1 is joined to a support 17 at each end corresponding to its two operative sectors. An arm 19 is attached to support 17, through articulation or pivot 18. The arm 19. The tilts due to the effect of a hydraulic cylinder 20 Arm 19 has an elbow shape so that it can adopt the vertical position shown in FIG. 3 or a horizontal position where it rests on top of the box of cores. At the end of arm 19 there is a set of slide guides 21, which are attached to a plate 22 which is actuated by a hydraulic cylinder 23; plate 22 embodies two sets of clamps 24 which are operated by hydraulic cylinders 25 to grasp the upper half box of cores 16, as shown in FIGS. 3 and 4.

Based on the above described structure and an assembly of the different elements which make up the box on the set of rollers 7, the opposite to what is shown in FIGS. 3 and 4, the ancillary mechanism and drive action of cylinder 20, is capable of adopting a horizontal arrangement for plate 22 where this plate faces the box of cores in the assembly allowing the rear plate later on to drop, by effect of cylinder 23, until it meets the upper half box of cores 16, when the actuation of cylinders 25 causes closure of clamps 24 and the consequent locking of the upper half box of bores 16. The opposite drive action of cylinder 23 is then performed to lift the half box 16, and also an opposite drive action of cylinder 20, so that arm 19 is tilted until it reaches the cleaning position, which is clearly visible in FIG. 3.

In the specific case where the carriage is used for horizontal opening boxes of cores, there is a box holder frame 26 and two boxes of cores or tools 27–27', as is observed in FIG. 5. The ancilliary mechanism has basically the structural features of the above case, although with slight modifications and with the exception that the structure for each box of cores is double, that is to say, there are two lower supports 17' secured to frame 1 of the carriage, in counter-position in respect to the box of cores 26–27–27', to which are joined articulately through pivots 18' respective levers 19', which are tilted by effect of hydraulic cylinders 20', with the peculiarity that the levers now adopt an upright position, when arranged to hold the box of cores, compared with the horizontal position of the above case. Each of arms 19' has a plate 22' which is moved by effect of a hydraulic cylinder 23', also on guides; the plate 22' has a number of opposing sets of clamps 24', which are operated by hydraulic cylinders 25'.

In this case, the manoeuvre on the box of cores for cleaning the cores commences when plates 22' are brought near to the two boxes of cores 27–27', through the action of hydraulic cylinders 23'; when these plates make contact with these boxes 27–27', cylinders 25' are activated to effect the closure of clamps 24', and after boxes 27–27' are made secure, cylinders 23' are operated in the opposite direction, specifically spacing the plates, until the limit position thereof shown in FIG. 5. Then the lower hydraulic cylinders 20' are activated, making arms 19' tilt in the direction of arrows shown in FIG. 5, in order to reach the final position for cleaning the boxes of cores 27–27', permitting a similar manoeuvre and, in the opposite direction, after cleaning, to carry out a new setting of elements 26–27–27' that form the box, so that this can continue performing its job as a tool.

I claim:

1. Double carriage for automatic tool change in core making macines for casting, comprising a supporting frame; two sets of motor-driven rollers mounted on said frame for receiving respective tools or boxes of cores and enabling subsequent expulsion of said tools or boxes of cores, said supporting frame being provided with wheels which are adapted to run on rails positioned on the ground; a reduction motor secured to the frame and transmitting movement to shafts of said wheels to move said carriage; said carriage including two opoerative sectors each including an additional reduction motor positioned to said frame and adapted to drive a corresponding set of said rollers, and an intermediate shaft operatively interconnected between a corresponding additional reduction motor and a corresponding set of rollers to transmit movement from said additional reduction motor to said corresponding set of rollers, each operative sector further including an ancillary handling mechanism for the tools or boxes of cores, each handling mechanism being supported on said frame and adapted to open said tools or boxes of cores received by said rollers and after opening to place them in a suitable position for periodic cleaning.

2. Double carriage according to claim 1, wherein each ancillary mechanism is adapted for use with boxes of cores having a vertical opening and includes a support secured to said frame, an arm pivotally connected to said support, a first hydraulic cylinder connected to said arm to impart a tilting movement thereto, said arm having a free end, a set of guides provided on said free end, a plate supported on said set of guides, a second hydraulic cylinder connected to said plate for moving said plate along said guides, said plate including two sets of clamps, and third hydraulic cylinders provided on said plate to operate said clamps, said clamps being constructed to clamp and secure an upper half box of cores, whereby, upon actuation of said cylinders and tilting said arm, said plate can be placed in a horizontal position to face a box of cores, be lowered to make contact of the upper half of the box of cores with said clamps, lifted away from a lower half of a box of cores and tilted sideways until said upper half of the box of cores adopts a suitable position for cleaning.

3. Double carriage according to claim 1, wherein each ancillary mechanism is adapted for use with boxes of cores having a horizontal opening and includes two supports secured to said frame and positioned at two sides of a box of cores and encircling said rollers, two arms each pivotally connected to a respective support, two first cylinders connected to said arms, respectively, to impart a tilting movement thereto, each arm having a free end, two sets of guides each mounted on the free end of a respective arm, two plates each supported on a respective set of guides, two second cylinders connected to said plates, respectively, for moving said plates along respective sets of guides to and from said box of cores, said plates including two sets of clamps to be applied to two opposite sides of the box of cores, and third hydraulic cylinders provided on said plates to operate said clamps, whereby, upon actuation of said cylinders and tilting said arms, said plates are moved from an upright position and a maximum spacing thereof to bring two halves of a box of cores together and make contact therewith whereby said halves are grasped by said clamps and said plates are moved to a spaced-apart position thus dragging two halves of said box of cores therealong while said arms are tilted downwardly outwardly to further drag said two halves of the box therealong until said halves adopt a suitable position for cleaning.

* * * * *